US006843682B2

(12) United States Patent
Matsuda et al.

(10) Patent No.: US 6,843,682 B2
(45) Date of Patent: Jan. 18, 2005

(54) PLUG

(75) Inventors: Takeshi Matsuda, Tokyo (JP); Masaji Komuro, Tokyo (JP)

(73) Assignee: SMK Corporation, Tokyo (JP)

( * ) Notice: Subject to any disclaimer, the term of this patent is extended or adjusted under 35 U.S.C. 154(b) by 0 days.

(21) Appl. No.: 10/628,812

(22) Filed: Jul. 28, 2003

(65) Prior Publication Data

US 2004/0072461 A1 Apr. 15, 2004

(30) Foreign Application Priority Data

Aug. 30, 2002 (JP) ..... 2002-255165

(51) Int. Cl.[7] ..... H01R 13/40
(52) U.S. Cl. ..... 439/596; 439/459; 439/656
(58) Field of Search ..... 439/596, 459, 439/656

(56) References Cited

U.S. PATENT DOCUMENTS 4,226,494 A * 10/1980 Mazzeo et al. ..... 439/397
4,413,872 A * 11/1983 Rudy et al. ..... 439/467
5,482,475 A * 1/1996 Kawaguchi ..... 439/394
6,139,363 A * 10/2000 Ko et al. ..... 439/579
6,305,979 B1 * 10/2001 Ko ..... 439/579
6,428,345 B2 * 8/2002 Sawayanagi et al. ..... 439/456
6,634,903 B2 * 10/2003 Gunreben et al. ..... 439/459

FOREIGN PATENT DOCUMENTS

JP 2002-75485 3/2002

* cited by examiner

*Primary Examiner*—Gary F. Paumen
(74) *Attorney, Agent, or Firm*—Gauthier & Connors LLP

(57) ABSTRACT

The present invention relates to a plug for the connection of wires, which provides sufficient retaining force for lead-in wires (5, 7) to prevent the lead-in wires (5, 7) from breaking, and provides contact resistance of predetermined value.

7 Claims, 9 Drawing Sheets

PLUG

FIELD OF THE INVENTION

The present invention relates to a plug for the connection of lead-in wires to a hi-fi equipment and, in particular, a plug for the connection of lead-in wires formed of a pair of L- and R-signal lines to speakers and hi-fi equipments.

BACKGROUND OF THE INVENTION

Machines that make use of lead-in wires to lay out the circuits, such as an amplifier and speaker for a hi-fi equipment, are connected to each other by connection wires formed of a pair of L- and R-signal wires. The connection between these machines are normally achieved by stripping the tips of the lead-in wires, and then connecting the stripped tips to the connection members known as lever type connection plugs 103 mounted on the terminal plates 101 of the machines (refer to FIG. 10).

In the lever type connection plug 103, the lever 105 can resist the torque of the spiral spring 107 to rotate clockwise, so that the end of a stripped lead-in wire 109 can be inserted into the hole 111. After this, the lever 105 resumes its original position, and the lead-in wire 109 is moved to locate in between the contact member 113 of the lever 105 and the contact member 117 located within the housing 115 of the connection plug 103, to provide electrical connection to the contact member 117 of the machine side.

For the recent hi-fi equipments, besides the two-channels input, there are also multiple signal inputs of four-channels and six-channels. Under the circumstances, for each channel, it is necessary to connect the lead-in wires 109 composed of two signal lines. Therefore, as shown in FIG. 11, multiple lever type connection plugs 103 are arranged on the terminal plate 101 at the back of the machine.

However, it is unesthetic to locate the connection portion of the lead-in wire 109 on the surface of the machine. Therefore, normally the terminal plates 101 are located on the rear of the machine. Since it is required to perform lay out of the wire at the rear of the machine where the user is difficult to view, it is difficult to perform the lay out. Furthermore, since the diameter of the lead-in wire 109 ranges from 0.76 to 1.27 mm., it may be not possible to securely retain all the lead-in wires 109 of various diameters to perform electrical connection.

To overcome the above defects, the applicant provides the plug for connecting electrical wires 200 as disclosed Japanese Patent Application No. 2002-75485 (see FIGS. 12 to 14).

With reference to the plug 200, the lead-in wires 3 composed of a pair of signal lines 3 are inserted into the respective openings 211, 211 of the rear portion of the housing 210. The housing 210 with the lead-in wires 5, 7 connected thereto is inserted into the slot 139 of socket 127 located on the terminal plate 137 of the machine rear surface.

The shape of the housing 210 corresponds to the cross-sectional shape of the slot 139. A recess 212 is formed at one side of the housing 210, and is adapted to engage with the rib 141 formed on an inner face of the slot 139. Therefore, the plug 200 is insertable only when the recess 212 engages the rib 141, and thus accidental insertion of the plug may be avoided.

Wire connecting head 220 suitable for resiliently connecting with the machine side terminals (plug-in terminals) 131 is mounted in the housing 210. The wire connecting heads 220 correspond to the pair of lead-in wires 5, 7, and are stacked in the housing 220 (see FIG. 12).

A zigzagging plate-like spring piece 223 is integrally formed on one side of the wire connecting head 220. A recess 225 is formed on the spring piece 223, and is engageable with the urging portion 231 of the rotating lever 230.

The rotating lever 230 is in the shape of an inverted "L." By rotating the operating portion 232 extending from the housing 210, the spring piece 223 is urged towards the direction of the lead-in wires 5, 7 by the front end of the urging portion 231.

As shown in FIG. 14, in the course of rotation, the urging portion 231 moves to engage with the recess 225 of the spring piece 232. At this instant, the stripped portions 250 of the lead-in wires 5, 7 are clamped to secure in the inner wall face of the housing 210 by the front end of the spring piece 223. Therefore, the lead-in wires 5, 7 are electrically connected to the wire connecting head 220, and can be electrically connected to the machine side terminals 131 via the wire connecting head 220.

In this kind of connection plug 200, the plug 200 is inserted into the slot 139 of socket 127 located on the machine, and the lead-in wires 5, 7 are connected to the machine side terminals 131. Therefore, the connection can be easily achieved even at the machine rear side. The plug 200 is well adapted for lead-in wires 5, 7 of various diameters.

[Problems to be Solved]

In the connection plug 200 shown in FIGS. 12 to 14, the front end of the spring piece 223 is pressed to secure the lead-in wires 5, 7. Although the lead-in wires 5, 7 will not be loosen easily, the retaining force for such connection plug 200 is insufficient.

In other words, when the user removes the plug 200 from the socket 127, the lead-in wires 5, 7 may be accidentally pulled. If the force for retaining the lead-in wires 5, 7 does not exceed the force for removing the plug 200 from the socket 127, for example 5 kg, the lead-in wires 5, 7 may be removed before the plug 200 is removed from the socket 127.

The above-mentioned known plug 200 which retains the lead-in wires 5, 7 by clamping only is limited in its retaining force, and thus has the above defect.

Further, since the stripped portion 250 of the lead-in wires 5, 7 are clamped by the sharp edges of the front end of the spring piece 223, the stripped portion 250 apt to be easily broken partially, and the lead-in wires will no longer function.

The broken portion of the stripped portion 250 may remain in the housing 210 or socket 127, and may result in poor insulation.

The location of the front end of the spring piece 223 urging against the lead-in wires 5, 7 may vary due to the insertion condition of the lead-in wires 5, 7. Therefore, the flexure amount of the spring piece 223 may vary, and will result in the instability of the contact pressure of the lead-in wires 5, 7. Consequently, the contact resistance will vary and the electrical connection having a predetermined value may not be attained.

The present invention is intended to overcome the above drawbacks, and provides a socket connector for electrical wires having sufficient retention force, which may prevent the wires from breaking and to provide a contact resistance of predetermined value.

SUMMARY OF THE INVENTION

To overcome the above problem, a first aspect of the present invention is characterized by having a casing insertable into or removable from a machine side socket, and divided into a wire-insertion chamber and a connector-receiving chamber by a partition, a connector received in the connector-receiving chamber and has a plate spring contact portion at one side urging towards a connecting hole of a partition in communication with the wire-insertion chamber, and an external contact at the other side connecting to a machine side terminal of the machine side socket, a housing rotatably mounted in the casing, and has a projecting portion projecting beyond the connecting hole of the partition from the wire-insertion chamber when the housing is rotated to the side of the casing, the wires inserted within the wire-insertion chamber are pressed into the connecting hole by the rotation of the projecting portion of the housing towards the casing, the wires are bent to clamp in between the inner wall of the projecting portion and connecting hole, the wires projecting beyond the connecting hole along the surface of the projecting portion are resiliently connected to the plate spring contact portion, whereby the wires are electrically connected to the machine side terminals when the casing is inserted into the machine side socket.

In the above embodiment, the wires are bent by means of the housing rotated towards the casing side so as to be clamped in between the inner wall of the projecting portion and connecting hole, and thus the inserted wires can be firmed retained.

Since the wires projected beyond the connecting holes along the surface of the projecting portion are resiliently contacted by plate spring contact portion of the connector, the wires will not be urged by the end face having sharp edge, and may effect electrical connection of the contacts by adjusting the resiliency of the plate spring contact portion.

Consequently, the wires will not break and can be repeatedly used.

In a second aspect of the present invention, the plug includes a contact protrusion formed on the plate spring contact portion which resilient contacts the wires, and the contact protrusion projects towards a pressing face of the projecting portion in contact with the contact protrusion, and the pressing face substantially intersects the deflection direction of the plate spring contact portion.

Since the contact protrusion resiliently contact the wires in line or in point, a reliable contact can be achieved.

The pressing face of the wires are bent along the surface of the projecting portions and the portion of the pressing face along the wires extend beyond the straight line intersecting the deflection direction of the plate spring contact portion perpendicularly. Therefore, even if the contact position of the contact protrusion shifts, the deflection amount of the plate spring contact portion will not vary, and thus may achieve stable electrical connection.

By means of the planar pressing face, the wires will not be urged by sharp edges of the projecting portion, and thus will preclude the breakage of the wires.

According to a third aspect of the present invention, the portions of the casing partitioned by a guide slot mounted in the insertion direction of the wires form the wire-insertion chamber and the connector-receiving chamber, and a guide plate is formed on the housing, and loosely fit into the guide slot to guide the rotation of the housing. A pair of wires inserted into each wire-insertion chamber is pressed in by a pair of projecting portions formed on both sides of the guide plate to electrically connect to contacts received in the connector-receiving chamber.

Upon rotation of the housing, the guide plate will loosely fit into the guide slot to guide the rotation of the housing, and thus a pair of projecting portions will be accurately directed to the corresponding connecting holes to clamp a pair of wires simultaneously, and may direct the wires to the contacts.

In case a pair of the wires at one side is misinserted into the wire-insertion chamber at the other side, a portion of the wires will extend over the guide slot and interfere with the loosely fitted guide plate, and the housing cannot be rotated toward the casing. Under the circumstances, as soon as the user notices that the housing is not rotatable, he is aware that there exists abnormal wiring of the wires.

According to a fourth aspect of the present invention, the casing is formed of a transparent insulating material.

As the casing is transparent, misconnection can be avoided since it is possible to observe the insertion status of the wires outside the casing by vision.

According to a fifth aspect of the present invention, the casing is formed of an insulating material in a predetermined color so as to facilitate distinction by color.

As the casing is transparent, besides observation from outside by vision, by inserting the plugs in multiple colors into corresponding sockets painted in same colors for respective chapels, misconnection can be avoided even in multiple channel system.

The plugs for each of the channels of a multiple channel system can adopt a common kind.

BRIEF DESCRIPTION OF THE DRAWINGS

The present invention will now be described with reference to the accompanying drawings illustrating preferred embodiments, in which.

DETAILED DESCRIPTION OF THE INVENTION

Figure 1:
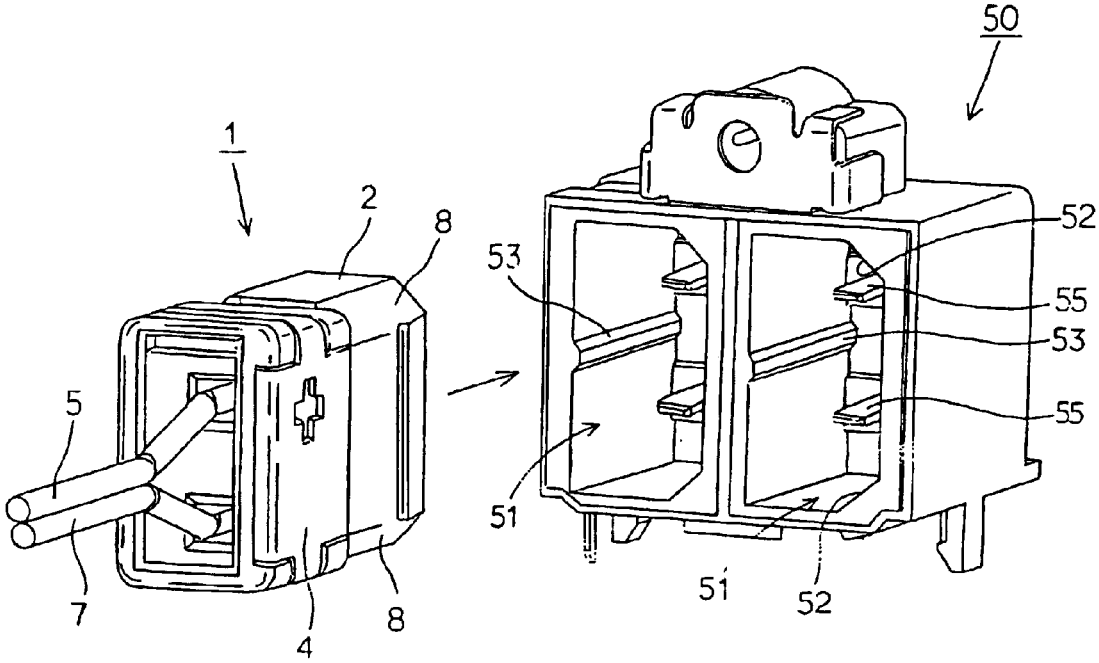
FIG. 1 is a perspective view of the first embodiment of the present invention, showing the status in which a plug 1 for connecting wires is inserted into a machine side socket 50.

Reference will now be made to the drawing figures to describe the present invention in detail. Referring to FIGS.

1 to 6, a preferred embodiment of the plug connector (hereinafter called as "plug") according to the present invention is disclosed.

The plug 1 is rotatably mounted within the housing 4 of the casing 2 The plug 1, for example the component for connecting the amplifier to the speaker for a hi-fi equipment, is removably inserted into a rectangular recessed portion 51 of a machine side socket 40. Therefore, the rotation of the housing 4 to cover the casing 2 will correspond to the sectional configuration of the recessed portion 51.

Figure 2:
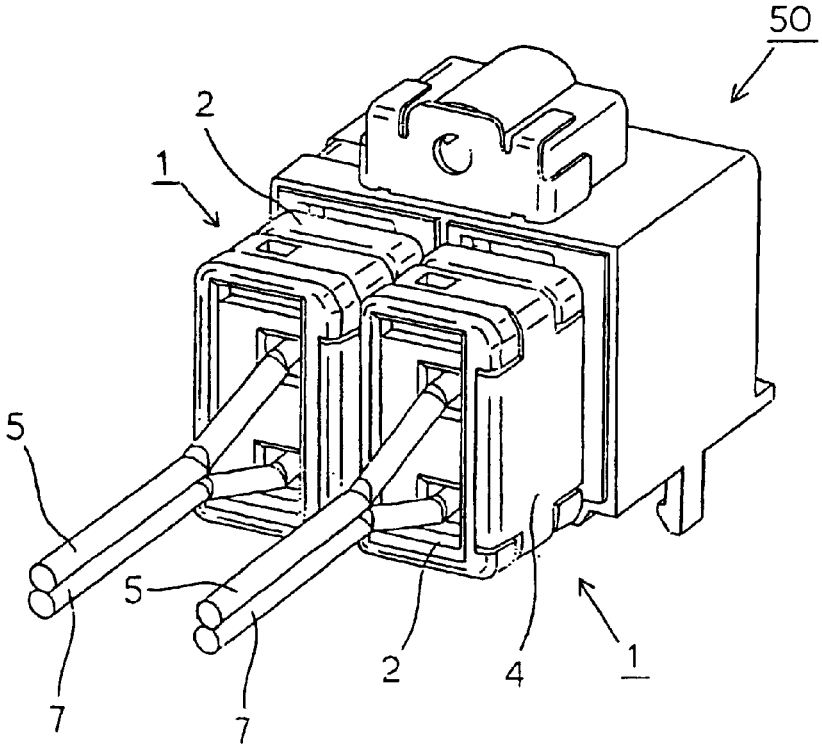
FIG. 2 is a perspective view showing the plug 1 in connection with wires 5, 7.

In this embodiment, a pair of recessed portions 51, 51 are juxtaposed in the socket 50 in a stereo mode configuration, as shown in FIG. 2. The recessed portions 51, 51 are adapted to receive corresponding plugs 1, 1. In FIG. 1, numeral 55 is designated for the machine side terminals mounted within the recessed portions 51. Terminal 55 is resiliently connected to the connector 15 so as to electrically connect the lead-wires 5, 7 of each channel.

Under the condition that housing 4 is overlapping the casing 2, oblique faces 8 facing the oblique faces 52 located at one side of the upper and lower portions of the recessed portions 51 are correspondingly arranged at the external edges. A groove 9 is provided on one side of the casing 2 for receiving the rib 53 provided on the inner face of the recessed portion 51 (see FIG. 3). In this way, the misinsertion of the plug 1 into the socket 50 can be avoided.

Figure 3:
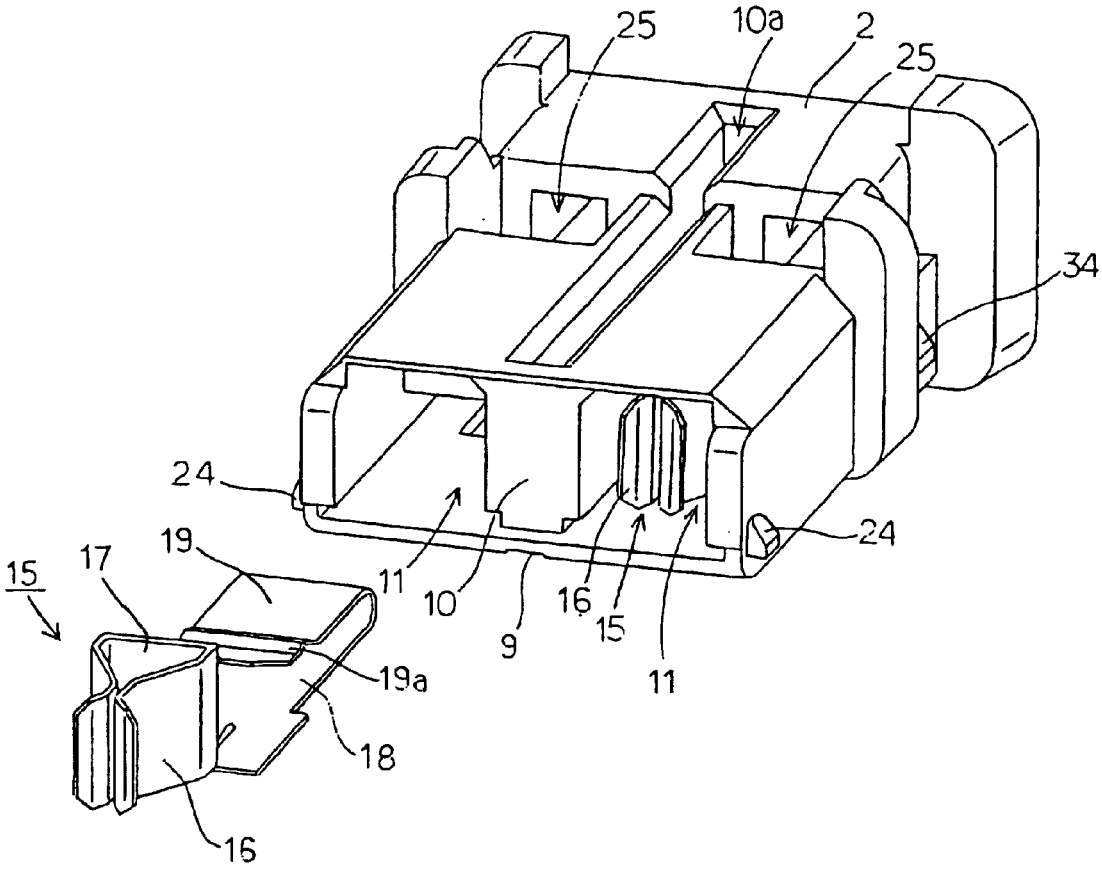
FIG. 3 is a perspective view of the connector 15 and casing 2, viewed from the front end.
Figure 6:
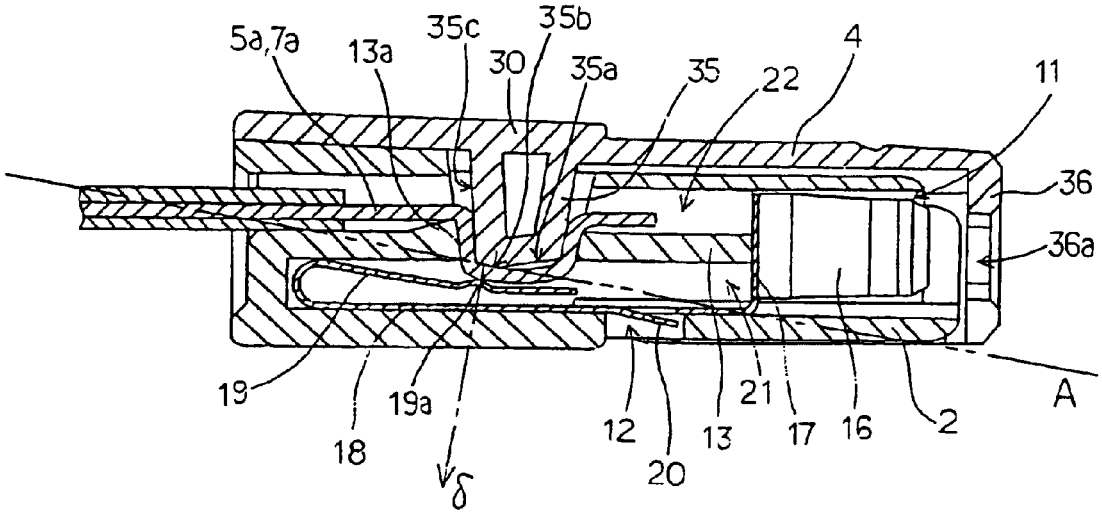
FIG. 6 is a longitudinal, sectional view showing the status in which the housing 4 is rotated towards the casing.
Figure 7:
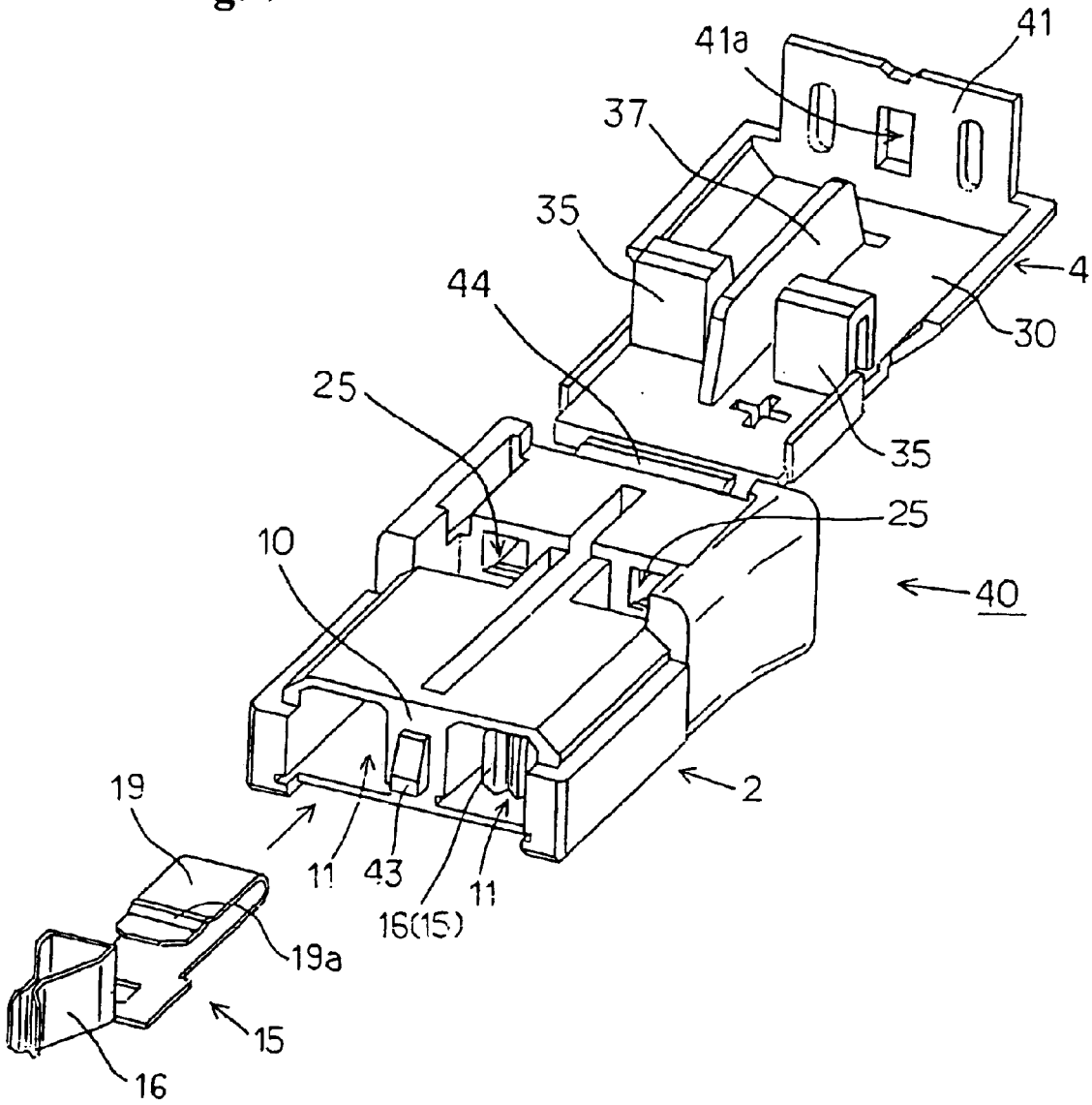
FIG. 7 is a perspective view of the second embodiment of the present invention, viewed from the front end of the plug 40.

As shown in FIG. 3, housing 2 is rectangular in shape, and is divided into a right and left chamber 11 by a partition 10. As shown in FIGS. 6 and 7, each chamber is divided into a wire-insertion chamber 22 at the top, and a connector-receiving chamber 21 at the bottom by a partition 13. The lead-in wires 5 or 7 are inserted into the wire-insertion chamber 22 from the back (see FIGS. 6 and 7), and the connector 15 is disposed in the connector-receiving chamber 21 from the front.

Figure 5:
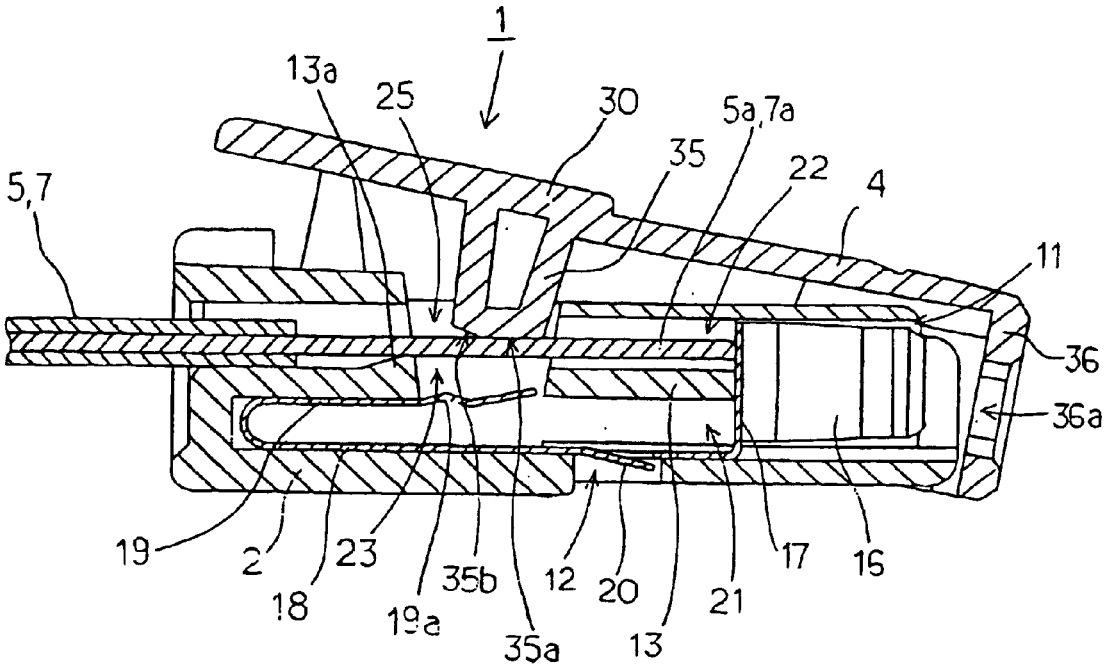
FIG. 5 is a longitudinal, sectional view showing the status in which the wires 5, 7 are inserted into the housing.

As shown in FIGS. 3, 5 and 6, the connector 15 comprises: a pair of contacts 16 resiliently holding the machine side terminals 55 by insertion to contact the terminals 55 to serve as external connecting portions, a support piece 17 extending vertically from the base ends of the contacts 16, and horizontally supporting the contacts 16 in a cantilever manner, a connecting piece 18 horizontally extending from the support piece 17 towards the insertion side of the wires 5, 7, and a plate spring contact portion 19 formed by bending the free end of the connecting piece 18 into a U-shaped configuration, and which can urge toward one side of the wire-insertion chamber 22.

A stop member 20, which protrudes from the intermediate of the connecting piece 18, terminates at the stop window 12 of the casing 2.

The connector 15 inserts into the connector-receiving chamber 21 from the front until the stop member 20 engages within the stop window 12 to prevent the connector 15 from disengaging from the front end, and thus the connector is secured in the casing 2. Under this secured condition, a support 17 and a partition 13 formed in each chamber 11 of the casing 2 serve to stop further insertion of the connector.

The plate spring contact portion 19 is bent at the connecting piece 18 so as to have resiliency. The plate spring contact portion 19 extends horizontally beneath the stripped portion 5*a*, 7*a* of the lead-in wires 5, 7 located in the wire-insertion chamber 22. A contact protrusion 19*a* is provided along the width direction of the plate spring contact portion 19. The contact protrusion 19*a* projects higher than the remaining portions of the plate spring contact portion 19, and is formed to face the connecting hole 23 to be described hereinafter. As the contact protrusion 19*a* is facing the connecting hole 23, it resiliently contacts the stripped portion 5*a*, 7*a* of the lead-in wires 5, 7.

As shown in FIG. 5, the connecting hole 23 is provided lengthwise at the intermediate position of partition 13 so as to arrange the connector-receiving chamber 21 and the wire-insertion chamber 22 in connection mode. Under the circumstances, the periphery of the lead-in wires 5, 7 will form into a bulge 13*a* which is thicker than the other portions.

A window 25, which opposes the wire-insertion chamber 22 and into which the projecting portion 35 is inserted, is formed on the casing 2 at a position above the connecting hole 23.

The housing 4 is substantially formed of a frame comprising a top cover 30, a pair of side plate portions 31 extending vertically downwards from both sides of the top cover 30, and a front plate portion 36 extending vertically at the front end of the top cover 30. The housing 4 so formed is suitable for covering the casing 2 from the top. To avoid the misinsertion of a pair of wires 5, 7 into the wire-insertion chamber 22 located at the other side, a crossed recess for guiding is formed on a asymmetric position of the top cover 30. A pivot hole 31*a* with which a rotating shaft 24 of the casing 2 is engaged is provided on the side plate portion 31 of the housing 4. The housing 4 is rotatably mounted on the casing 2 by pushing the rotating shaft 24 to engage the pivot hole 31*a*, and thus the housing 4 can be loaded on or removed from the casing 2.

At the rear of the side plate portion 31, a pair of engaging legs 32, 32 vertically extend from the top cover 30. Each of the engaging legs 32, 32 is provided with a hole 32*a* which may engage with a projection 34 formed on the external surface of the casing 2 when the housing 4 is rotated to cover the casing 2. By such engagement, the housing 4 and casing 2 are formed into an integral structure. Under this integral condition, the plug 1 is inserted into the recessed portion 51 of the socket 50. The front plate portion 36 is provided with apertures 36*a* to communicate with the chambers 11, and to guide the machine side terminals 35 to the contacts 16 of the connectors 15 received within the connector-receiving chambers 21.

A pair of vertically extending projecting portions 35 is arranged on the inner surface of the top cover 30. As shown in FIGS. 5 and 6, projecting portions 35 are substantially hollow, thick and polygonal in sectional view. The base of the projecting portion 35 is formed by an avoid face 35*a* located at the front (right side of the drawing), and a pressing face 35*b* in continuous with the avoid face 35*a* and located at the rear (left side of the drawing).

In FIG. 6 in which the housing 4 is shown to lie in a substantially horizontal configuration, the avoid face 35*a* is a surface facing forwardly and tilting upwardly, while the pressing face 35*b* is a surface facing rearwardly and tilting gradually upwards and in continuous with the rear portion 35*c* of the projecting portions 35. As shown in the drawing, the pressing face 35*b* is tilted in such a manner that the opaque plane A constituting the pressing face 35*b* intersects the deflection direction δ of the plate spring contact portion perpendicularly.

Upon the rotation of housing 4, the projecting portion 35 will enter the wire-insertion chamber 22 through the window 25 to bend the stripped portions 5*a*, 7*a* of the wires 5, 7 within the wire-insertion chamber 22. Besides, the projecting portion 35 protrudes from the wire-insertion chamber 22 beyond the connecting hole 23 of the partition 13, so that the stripped portions 5*a*, 7*a* are exposed beyond the connector-receiving chamber 21 and bent into the shape of a "⊐".

In pressing the wires 5, 7 by means of the projecting portion 35, the base of the front end of the projecting portion 35 is directed towards the avoid face 35*a* with the front end thereof inclined upwardly. Therefore, the stripped portions 5*a*, 7*a* of the wires 5, 7 are pressed by the pressing face 35*b* which comes to be planar and does not push into the wires.

Therefore, the sharp edges of the projecting portion 35 will not urge against the wires 5, 7 to break the wires 5, 7. The wires 5, 7 can thus be inserted or removed for repeated use.

The stripped portion 5*a*, 7*a* pressed by the pressing face 35*b* protrudes beyond the connector-receiving chamber 21 to resiliently contact the plate spring contact portion 19 urging towards the connecting hole 23. Since the resilient contact is effected by the contact protrusion 19*a* formed widthwise of the plate spring contact portion 19, the contact protrusion 19*a* and the stripped portions 5*a*, 7*a* are in line contact.

The stripped portions 5*a*, 7*a* of the wires 5, 7 resiliently contacted by the contact protrusion 19*a* are exposed beyond the pressing face 35*b* which intersects the deflection direction δ of the plate spring contact portion perpendicularly. Therefore, even if the contact position of the contact protrusion 19*a* shifts, the deflection amount of the plate spring contact portion 19 will not vary, and the contact resistance will also not vary, and thus may achieve stable electrical connection.

In the preferred embodiment as shown in FIG. 5, the wires 5, 7 with the front end thereof stripped off are inserted from the back into the wire-insertion chamber 22 of the casing 2 with the connector 15 mounted thereon. The front end of the stripped portion 5*a*, 7*a* of the lead-in wires 5, 7 are inserted until it urges against the upstanding support 17. Once the support 17 is touched, the operator will be able to sense the touch. This will alert the operator not to further insert the wires 5, 7, which may allow the wires 5, 7 to extend beyond the connecting holes 23, thus result in poor connection.

In case the wires 5, 7 are inserted, the plate spring contact portion 19 of the connector 15 are arranged in juxtaposition with the stripped portion 5*a*, 7*a* of the lead-in wires 5, 7, with the partition 13 in between.

Then, the housing 4 mounted in the casing 2 is rotated toward the side of the casing 2. By such rotation, the projecting portion 35 of the housing 4 will enter the window 25 of the chamber 11 to allow the pressing face 35*b* to press the stripped portions 5*a*, 7*a*.

Further, upon the rotation of the housing 4, the wire-insertion chamber 22 will bend the stripped portion 5*a*, 7*a* into the shape of a "⊐" in one end, and enter the connector-receiving chamber 21 through the connecting hole 23 of the partition 13 to contact the plate spring contact portion 19 on the other hand. By inserting the plug 1 (with the wires 5, 7 in connection with the connector 15) into the recessed portion 51 of the socket 40, the electrical connection between the wires 5, 7 and the machine side terminals 55 are achieved by the connector 15.

In this embodiment, as the stripped portions 5*a*, 7*a* of the lead-in wires 5, 7 are bent into the shape of a "⊐" along the surface of the projecting portion 35, the retention force for the wires 5, 7 are increased. Therefore, when the plug 1 is removed from the socket 50, even if the wires 5, 7 are grasped, the plug 1 will be removed as a whole, instead of pulling the wires 5, 7 off the plug 1 alone.

In this embodiment, as a bulge 13*a* is formed along the periphery of the connecting hole 23, the wires 5, 7 can be bent to a greater extent, thereby increasing the retention force of the wires 5, 7.

Figure 4:
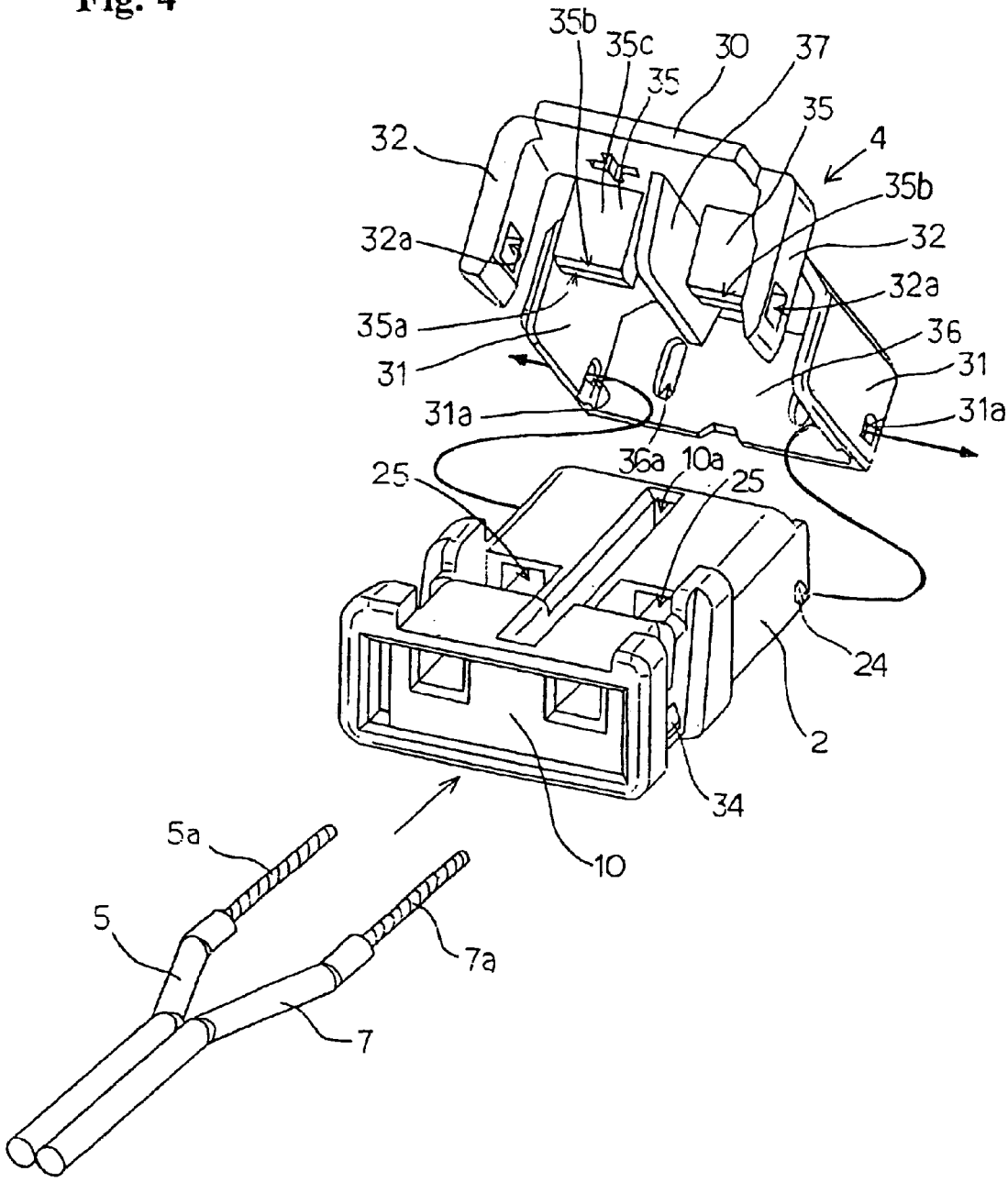
FIG. 4 is a perspective view of the casing 2 and housing 4, viewed obliquely from the rear.

In this embodiment, as shown in FIG. 4, a guide plate 37 is formed on the housing 4. The guide plate 37 is formed on the partition 10 dividing the chambers 11, 11 (wire-insertion chambers 22, 22), and is arranged to loosely fit into a guide slot 10*a* which opposes the insertion direction of the wires 5, 7.

As the housing 4 is rotated towards the casing, since the guide plate 37 is guided towards the guide slot 10*a*, the housing 4 will not be tilted during its rotation. Therefore, the projecting portion 35 can accurately project beyond the connecting hole through the window 25.

In case the wires 5, 7 inserted into one of the chambers accidentally enter the other of the chambers, the wires 5, 7 will extend over the guide slot 11*a* and interfere with the guide plate 37, and thus the housing 4 cannot be rotated toward the casing. Under the circumstances, any abnormal wiring of the wires 5, 7 can be noticed prior to its connection with the socket 50.

Figure 8:
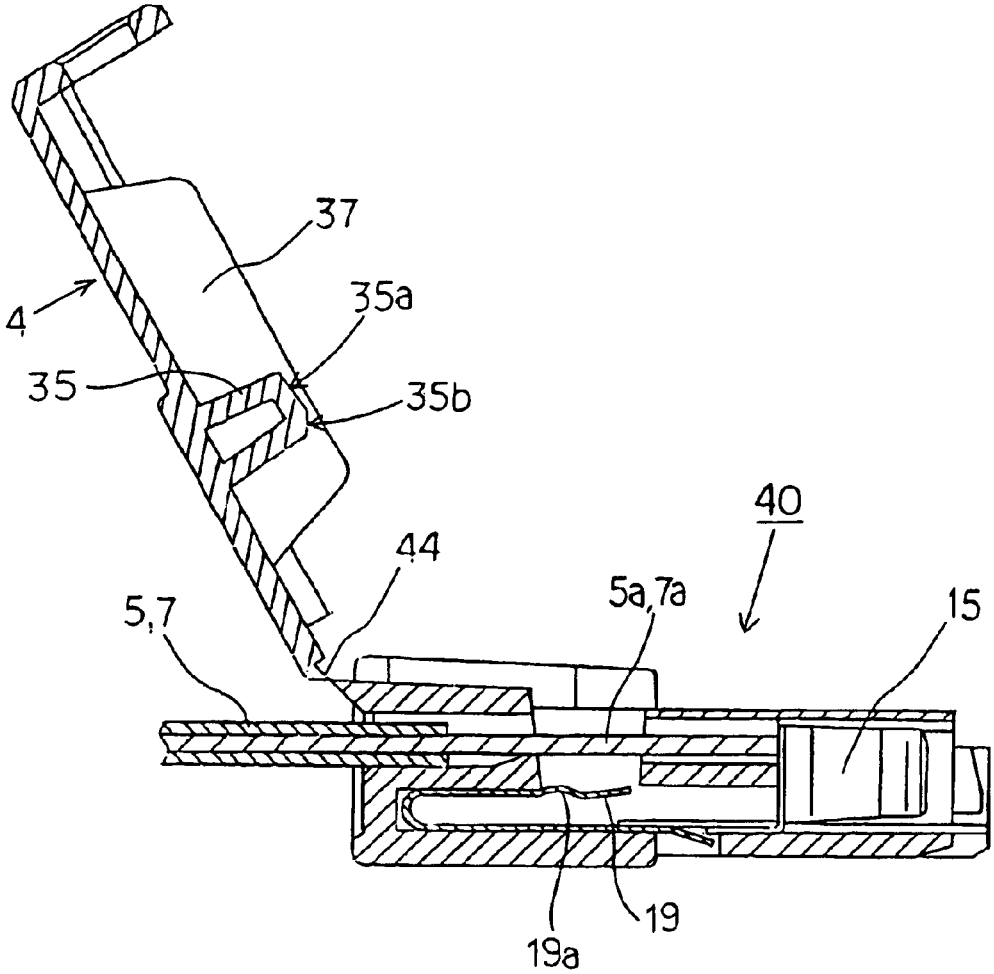
FIG. 8 is a longitudinal, sectional view showing the status in which the plug 40 of the second embodiment is inserted with wires 5, 7.
Figure 9:
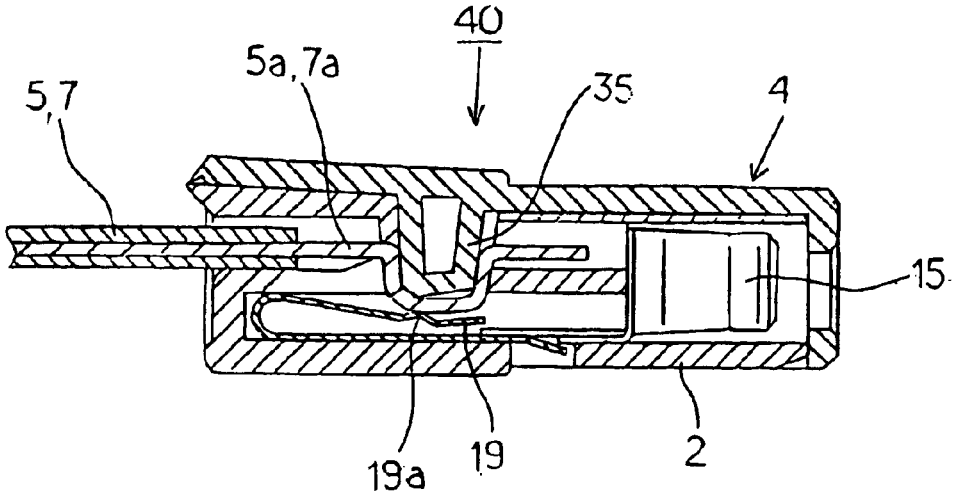
FIG. 9 is a longitudinal sectional view showing the status in which the housing 4 is rotated towards the casing.
Figure 10:
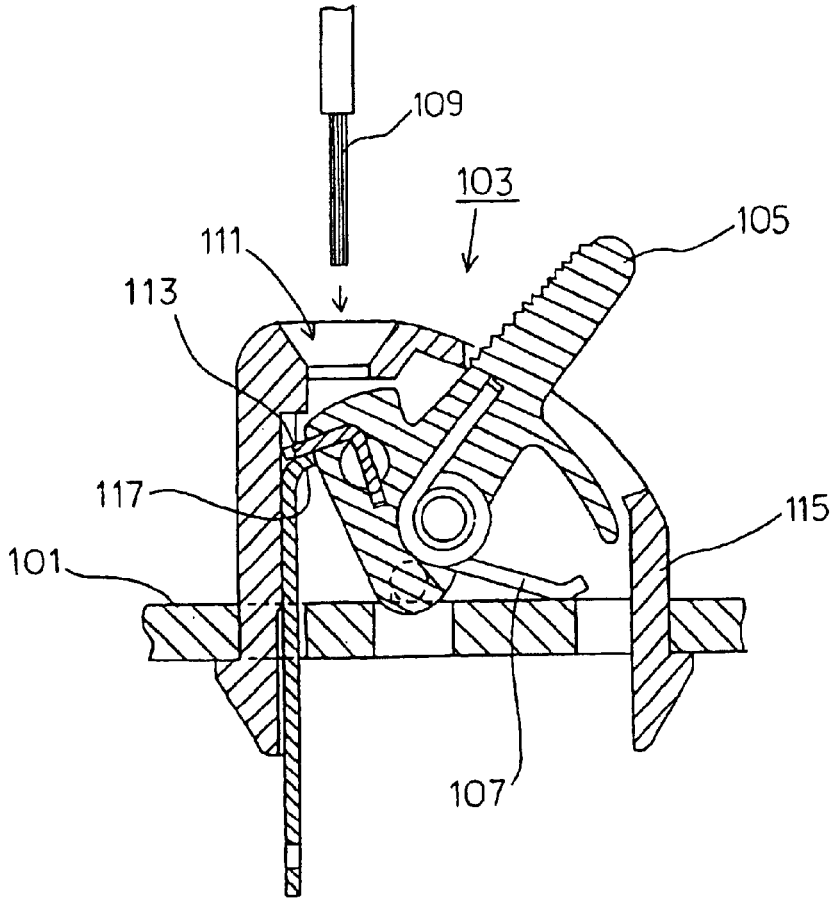
FIG. 10 is a longitudinal, sectional view of a conventional lever type connector terminal.
Figure 11:
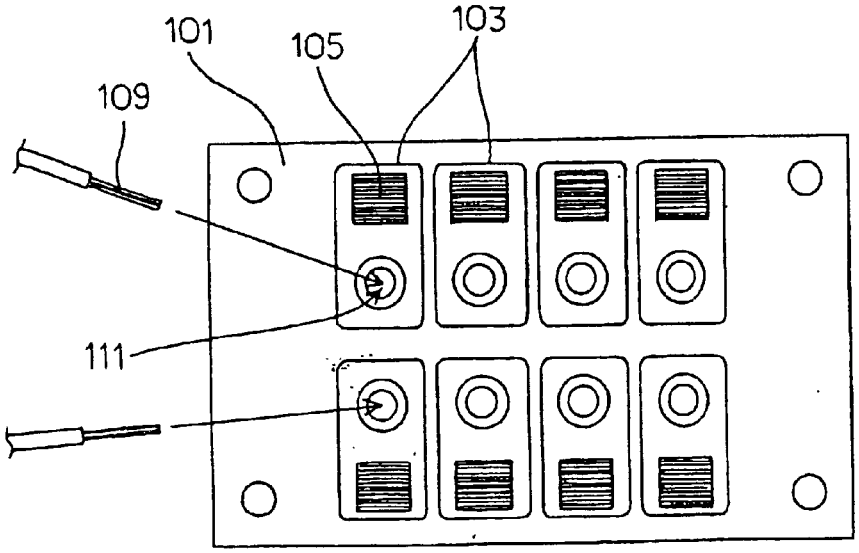
FIG. 11 is a rear view of the back of a machine arranged with a plurality of lever type terminals 103.
Figure 12:
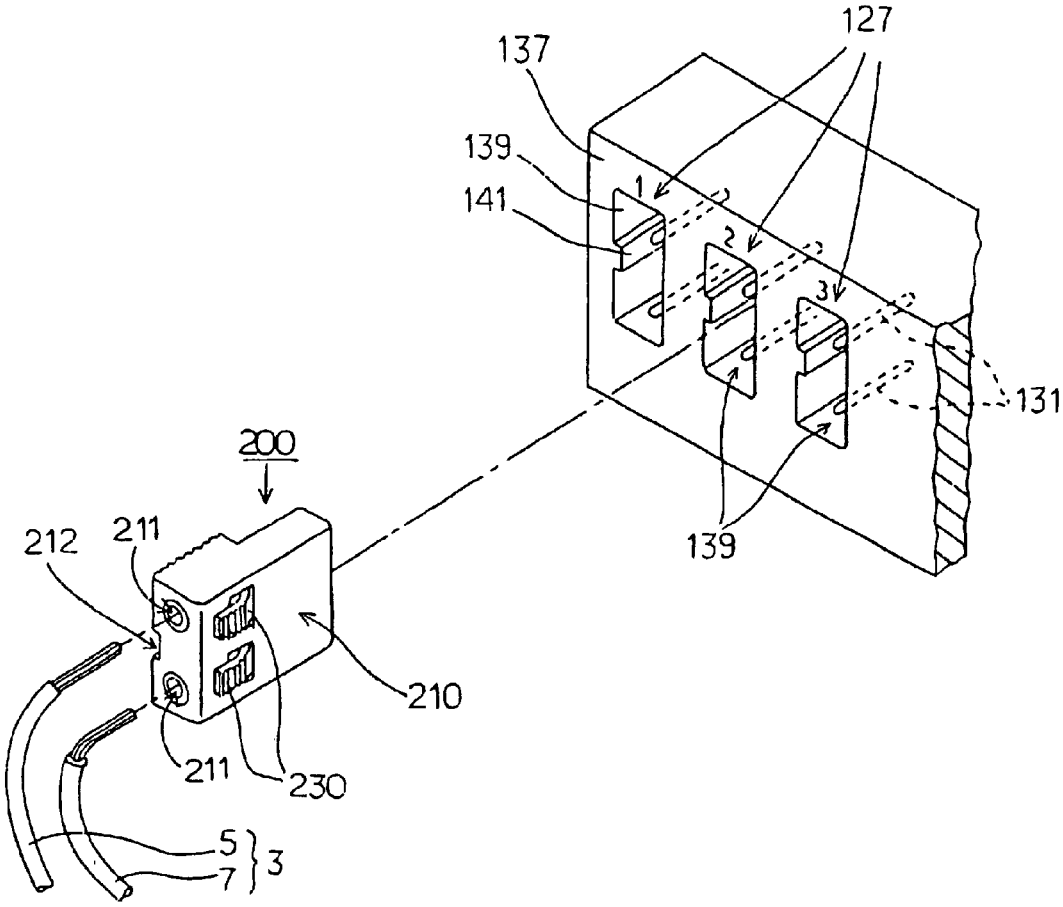
FIG. 12 is a perspective view showing a conventional plug 200 and a machine side socket 127.
Figure 13:
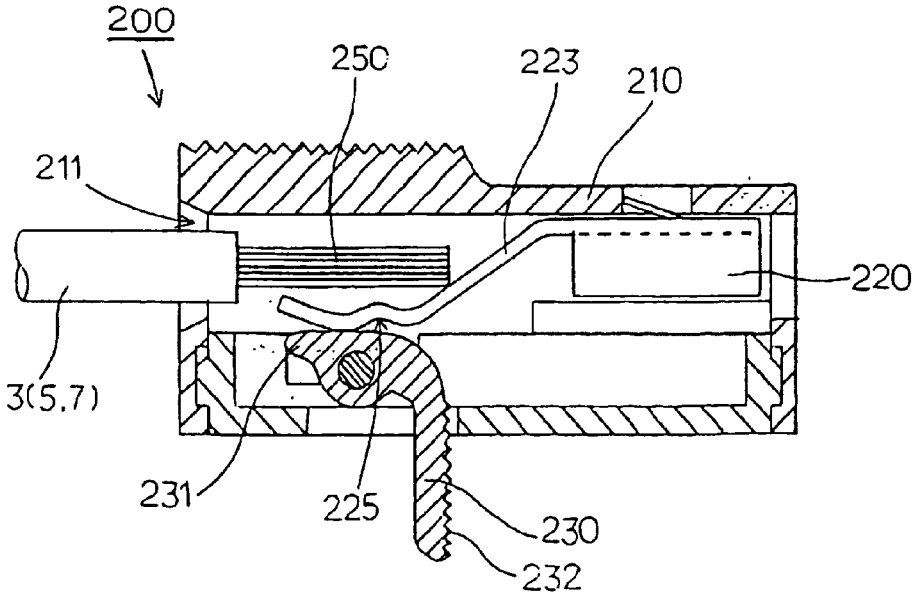
FIG. 13 is a longitudinal, sectional view of the plug 200.
Figure 14:
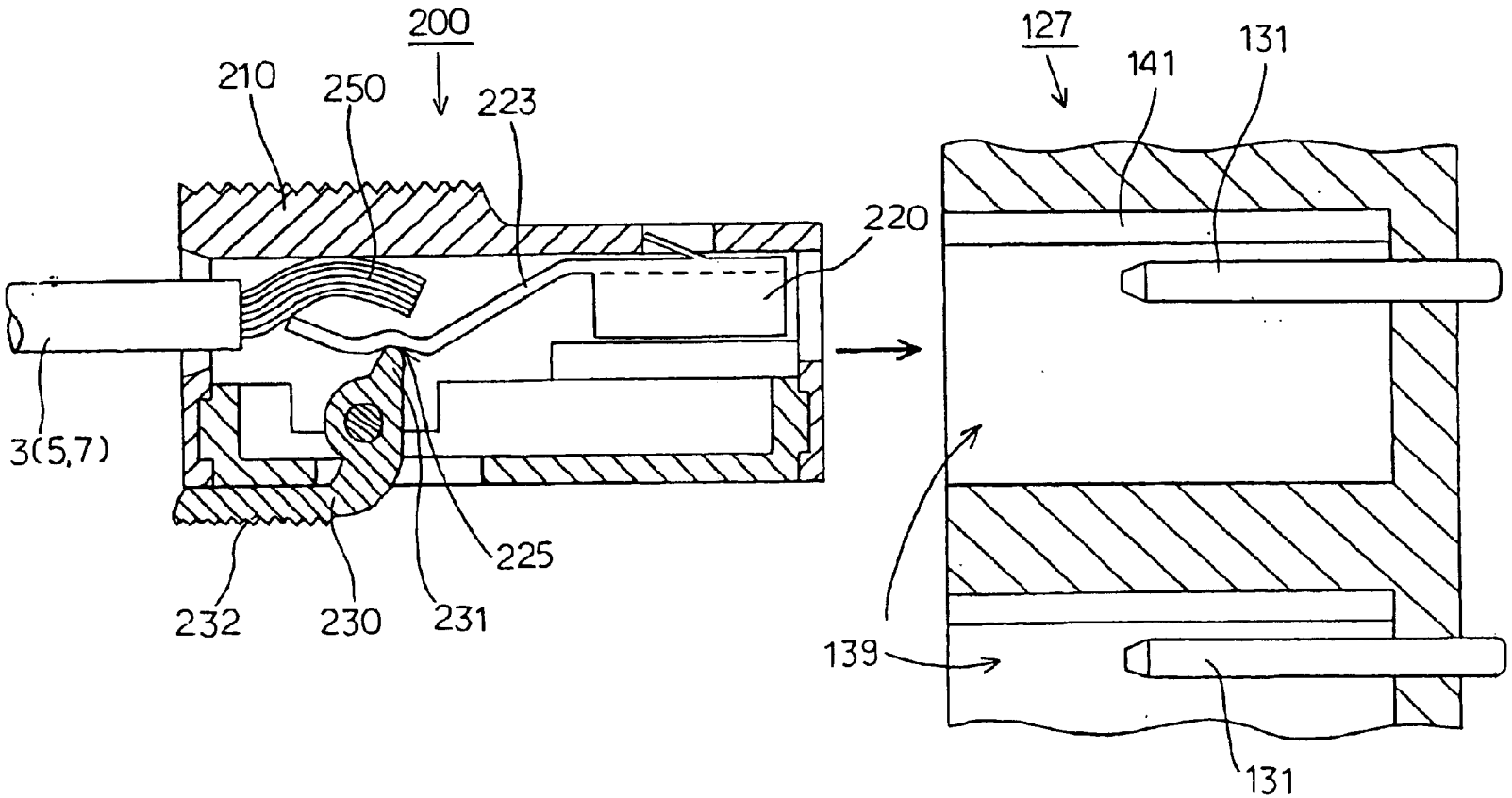
FIG. 14 is a longitudinal, sectional view showing the status in which the plug 200 is connected to the socket 127.

FIGS. 7 to 9 show a further embodiment of the present invention. The components equivalent to those of the above-mentioned embodiment are labeled with the same reference numerals. In this embodiment, the plug 40, casing 20 and housing 4 are connected to one another by means of a hinge 44.

Hinge 44 is a junction between the casing 2 and housing 4, which is laminated and rotatably connected to the casing 2 and housing 4. Therefore, the housing 2 is freely rotatable with respect to the casing 2. By connecting the housing 4 to the casing 2 with the aid of the hinge 44, the housing 4 and casing 2 can be formed to be an integral structure, and may preclude the loss of parts. Further, the number of molds for forming the plug 40, and the assembling procedures of the plug 40 can be reduced.

In this embodiment, the front plate portion 41 bent at and extend from the top cover 30 is integrally connected to the housing 4, and has an insertion hole 41*a* formed thereon. The housing 4 is fixed to the casing 2 by allowing the protrusion 43 formed on the front portion of the partition 10 to snap into the insertion hole 41*a*.

In this embodiment, the projecting portion 35 that bends the stripped portion 5*a*, 7*a* of wires 5, 7 into the shape of a "⊐" is formed on the housing 4. Further, a substantially planar pressing face 35*b* is formed on the projecting portion 35, and a contact protrusion 19*a* is formed on the plate spring contact portion 19, and thus provides the same effect as that of the embodiment shown in FIGS. 1 to 6.

Besides the above embodiments, the casing 2 of the present invention is made transparent, so that the insertion status of the wires 5, 7 in the casing 2 can be viewed from outside the casing 2 to avoid misconnection.

In plug 1 of the first embodiment, the casing 2 is transparent, and may also be coated with an insulating material of a predetermined color. For example, in the connection of multi-channel signals, the sockets 50 for different channels are painted with different colors, and the housing 4 of the plug 1 to be connected to the machine side socket 50 is painted with the same color as the socket. In this way, misconnection of machine side socket 50 for different channels can be precluded. By means of such color distinction, as long as the housings 4 are formed of different materials, the casing 2 can be used in common.

Further, in the first and second embodiments, a channel is generally provided with a pair of L- and R-signal lines. In the above descriptions, although it is stated that a plug 1, 40 with a pair of wires 5, 7 inserted therein are used, a plug with only a wire connected can also be used.

[Effects]

In the present invention, although the insertion of the wires is achieved by a procedure, the retention of the inserted wires and the electrical connection of the connectors are conducted separately. Consequently, the wires will not be damaged, and can be securely retained. Even if the plug is removed by pulling the wires the wires will not be pulled off.

According to a second aspect of this invention, as the plate spring contact portion 19 and the stripped portions 5*a*, 7*a* are in line contact, the contact pressure is stable, and may provide a stable contact resistance.

Besides, even if the resilient contact position shifts away from the direction of the pressing face, the deflection amount of the plate spring contact portion 19 will not vary. Since the contact pressure is stabilized, the electrical connection characteristic of the desired value may be obtained.

According to a third aspect of this invention, the rotation of the casing is guided by the guide plate and guide slot, and the casing is restrained to rotate when abnormal wiring of the wires exists. In this way, the housing and casing are not integrated. Therefore, firstly, the user may notice any abnormal wiring of the wires by observing the rotation of the wires; and secondly, short-circuit problem caused by connection can be avoided since it is not possible to insert the plug into the machine side socket.

According to a fourth aspect of this invention, misconnection can be avoided since it is possible to observe the insertion status of the wires by vision.

According to a fifth aspect of this invention, by inserting the plugs in multiple colors into corresponding sockets painted in same colors for respective channels, misconnection can be avoided even in multiple channel system.

What we claimed is:

1. A plug for the connection of electrical wires comprising:

a casing (2) insertable into or removable from a machine side socket (50), and being divided into a wire-insertion chamber (22) and a connector-receiving chamber (21) by a partition (13), a connector (15) received in the connector-receiving chamber (21), and having a plate spring contact portion (19) at one side urging towards a connecting hole (23) of a partition (13) in communication with the wire-insertion chamber (22), and an external contact (16) at the other side connecting to a machine side terminal (55) of the machine side socket (50), and a housing (4) rotatably mounted in the casing (2), and having a projecting portion (35) projecting beyond the connecting hole (23) of the partition (13) from the wire-insertion chamber (22) when the housing is rotated to the side of the casing (2), and in which the wires (5, 7) inserted within the wire-insertion chamber (22) are pressed into the connecting hole (23) by the rotation of the projecting portion (35) of the housing (4) towards the casing (2), the wires (5, 7) are bent to clamp in between the inner wall of the projecting portion (35) and connecting hole (23), the wires (5, 7) projecting beyond the connecting hole (23) along the surface of the projecting portion (35) being resiliently connected to the plate spring contact portion (19), and whereby the wires (5, 7) are electrically connected to the machine side terminals (55) when the casing (2) is inserted into the machine side socket (50).

2. The plug according to claim 1, wherein a contact protrusion (19*a*) being formed on the plate spring contact portion (19), and projecting towards a pressing face (35*b*) of the projecting portion (35) in contact with the contact protrusion (19*a*), which pressing face (35*b*) being substantially intersecting the deflection direction of the plate spring contact portion (19).

3. The plug according to claim 1 or 2, wherein the portions of the casing (2) partitioned by a guide slot (10*a*) which is mounted in the insertion direction of the wires (5, 7) form the wire-insertion chamber (22) and the connector-receiving chamber (21), a guide plate (37) being formed on the housing (4), and loosely fit into the guide slot (10*a*) to guide the rotation of the housing (4), a pair of wires (5, 7) inserted into each wire-insertion chamber (22) being pressed in by a pair of projecting portions (35) formed on both sides of the guide plate (37) to electrically connect to contacts (15) received in the connector-receiving chamber (21).

4. The plug according to claim 1 or 2, wherein the casing (2) is formed of a transparent insulating material.

5. The plug according to claim 3, wherein the casing (2) is formed of a transparent insulating material.

6. The plug according to claim 4, wherein the housing (4) is formed of an insulating material in a predetermined color so as to facilitate distinction by color.

7. The plug according to claim 5, wherein the housing (4) is formed of an insulating material in a predetermined color so as to facilitate distinction by color.

* * * * *